US005373913A

United States Patent [19]

Santos

[11] Patent Number: 5,373,913

[45] Date of Patent: Dec. 20, 1994

[54] LADDER STABILIZER COMPRISING INTERMEDIATE CONNECTION FROM LADDER TO VERTICAL STRUCTURE

[75] Inventor: Virgil Santos, Rodeo, Calif.

[73] Assignee: Joseph H. Couch, III, San Leandro, Calif. ; a part interest

[21] Appl. No.: 84,007

[22] Filed: Jun. 29, 1993

Related U.S. Application Data

[62] Division of Ser. No. 647,049, Jan. 29, 1991, Pat. No. 5,222,575, which is a division of Ser. No. 307,844, Feb. 8, 1989, Pat. No. 5,012,895.

[51] Int. Cl.[5] ..... E06C 7/00

[52] U.S. Cl. ..... 182/107; 182/93; 182/214

[58] Field of Search ..... 182/107, 108, 214, 93, 182/82, 100, 94, 97

[56] References Cited

U.S. PATENT DOCUMENTS

| | | | |
|---|---|---|---|
| 295,570 | 3/1884 | Lozier | 182/93 X |
| 1,102,461 | 7/1914 | Vaughan | 182/214 X |
| 1,203,313 | 10/1916 | Danke | 182/214 X |
| 1,576,695 | 3/1926 | Weber | 182/107 |
| 1,982,572 | 11/1934 | Colglazier | 182/107 |
| 3,903,991 | 9/1975 | Phelan | 182/93 X |
| 4,164,269 | 8/1979 | Jackson | 182/107 X |
| 4,615,412 | 10/1986 | Clarke | 182/107 X |
| 4,792,016 | 12/1988 | Ingalsbe | 182/107 |
| 4,924,971 | 5/1990 | Rice | 182/107 X |

FOREIGN PATENT DOCUMENTS

| | | | |
|---|---|---|---|
| 564729 | 2/1958 | Belgium | 182/108 |
| 1560528 | 2/1969 | France | 182/93 |
| 2623241 | 5/1989 | France | 182/107 |
| 231827 | 3/1911 | Germany | 182/107 |
| 664293 | 8/1938 | Germany | 182/93 |
| 2069579 | 8/1981 | United Kingdom | 182/93 |

*Primary Examiner*—Karen J. Chotkowski
*Attorney, Agent, or Firm*—David Pressman

[57] ABSTRACT

For enhancing the safety of a ladder, adjustable extensions (14) can be attached to the bottom ends of the side rails of the ladder so as effectively to adjust the lengths of such rails so that the ladder will not lean to either side, regardless of any difference in heights of the ground or support areas under such rails. Also coupling cables (66) couple the ladder to the wall of the building against which the ladder leans. The coupling cables connect the midpart of the ladder to a horizontal wall cable (64) which is attached along and parallel to the wall of the building. The top of the ladder is stabilized against rolling to either the left or right and so that it can be positioned stably against irregular supports, such as windows, eaves, pitched roofs, pipes, etc., by means of stabilizing bars (74) connected to its top and suitably shaped to mate with the irregular supports, and by extension arms (82) which project out from the top of the ladder. Hand holds (88) are attached to the extension arms.

4 Claims, 22 Drawing Sheets

FIG 4A
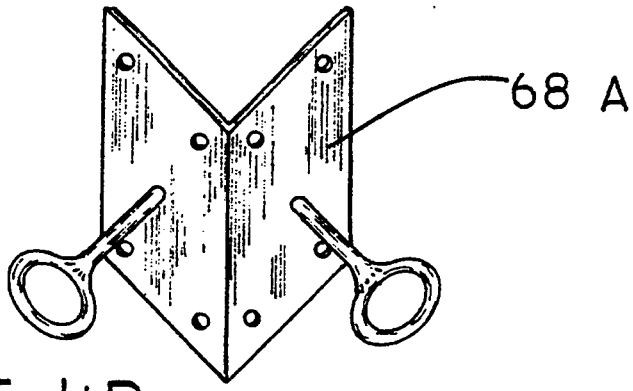
FIG 4B
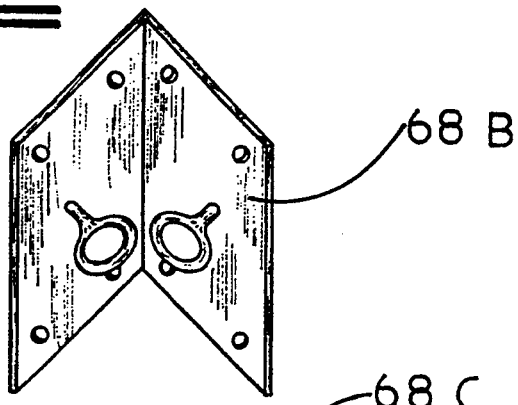
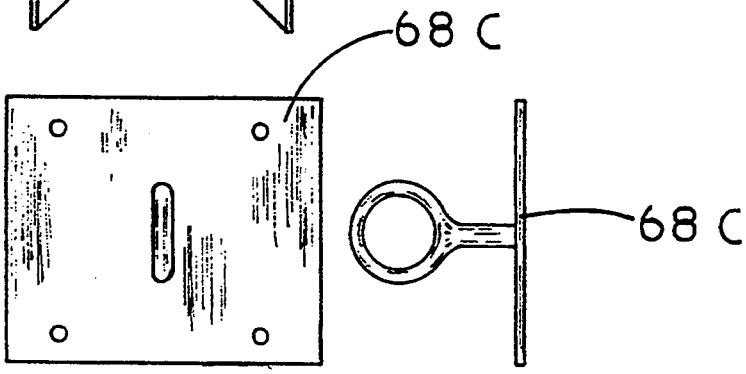
FIG 4D
FIG 4C

LADDER STABILIZER COMPRISING INTERMEDIATE CONNECTION FROM LADDER TO VERTICAL STRUCTURE

BACKGROUND—CROSS-REFERENCES TO RELATED APPLICATIONS

This is a division of Ser. No. 07/647,049, filed 1991 Jan. 29, now U.S. Pat. No. 5,222,575, granted 1993 Jun. 29, which is a division of Ser. No. 07/307,844, filed 1989 Feb. 8, now U.S. Pat. No. 5,012,895, granted 1991 May 7.

BACKGROUND—FIELD OF INVENTION

This invention relates generally to ladders, specifically to equipment for enhancing the safety of ladders.

BACKGROUND—DESCRIPTION OF PRIOR ART

Heretofore almost all types of ladders had a very unsatisfactory safety record. Perhaps the least safe were extension ladders. These are straight ladders which usually have several sliding sections; usually they are used by resting their top ends against a wall or the like. They often tended to fall, slip, collapse, etc., especially when used on uneven ground, adjacent irregular buildings, adjacent inside or outside corners of buildings, adjacent buildings with eaves, parapets, or overhanging roofs, buildings with roofs with irregular slopes, etc. When such ladders fell, slipped, rolled, etc. any workers using them also usually fell and were injured; these injuries were often serious and thus caused much pain and suffering, lost time from work, concomitant economic injury to families as well as workers, and often permanent disablement and or disfigurement.

In addition to injuries to workers, the increased litigiousness of society has created severe legal and fiscal problems for ladder manufacturers. These have become so serious that recently a national television show broadcast a lengthy feature on the problems of ladder safety, including the difficulties of obtaining liability insurance, defending lawsuits, paying large damages, adding numerous safety warnings on ladders, loss of executive time in dealing with lawsuits, etc. E.g., some executives of ladder manufacturers have been forced to spend up to 20% of their annual time dealing with lawsuits brought against their employers by injured plaintiffs. In addition, the prices of most ladders have been increased substantially to pay for increased liability insurance premiums, when available, or the increased cost of self insurance for some manufacturers since they could not even obtain insurance. Also, some ladder manufacturers have been forced out of business or into bankruptcy by huge damage judgments from lawsuits against them due to personal injuries because of falls from their ladders.

While apparatus for leveling ladders has been known for increasing stability on non-level surfaces, such apparatus has been awkward to use, install, and subject to failure or collapse in use. Anti-sway devices have been also known for use on the top of a ladder, but such devices were awkward to install, provided only slight stability, and were useful with only a small number of building configurations. Also these devices had to be installed permanently on their ladders, thereby reducing the versatility, eliminating certain applications of such ladders, and preventing other attachments from being installed on such ladders.

OBJECTS AND ADVANTAGES

Accordingly, several objects and advantages of the invention are to provide ladders with increased safety and with the ability to remain stable on irregular ground or irregular buildings, to prevent and reduce falls and the concomitant injuries to workers, and to reduce the legal and fiscal problems for ladder manufacturers, including reducing the amounts and frequencies of damages for injuries, the cost of liability insurance, the time and effort needed to defend lawsuits, the need for numerous safety warnings on ladders, the loss of executive time in dealing with lawsuits, the prices of most ladders, and the number of ladder manufacturers which go out of business due to damage judgments. Other objects are to provide removable safety attachments which do not interfere with or reduce the versatility or applications of ladders and which allow other attachments to be used with the ladders.

Additional objects and advantages are to provide ladders with rail extensions which can be used and installed easily, and which is less prone to failure or collapse in use, and to provide top stabilizing extensions which are easy to install, which provide increased stability, and are useful with a large number of building configurations.

Further objects and advantages will become apparent from a consideration of the ensuing description and the accompanying drawings.

DRAWING FIGURES

Figure 1A:
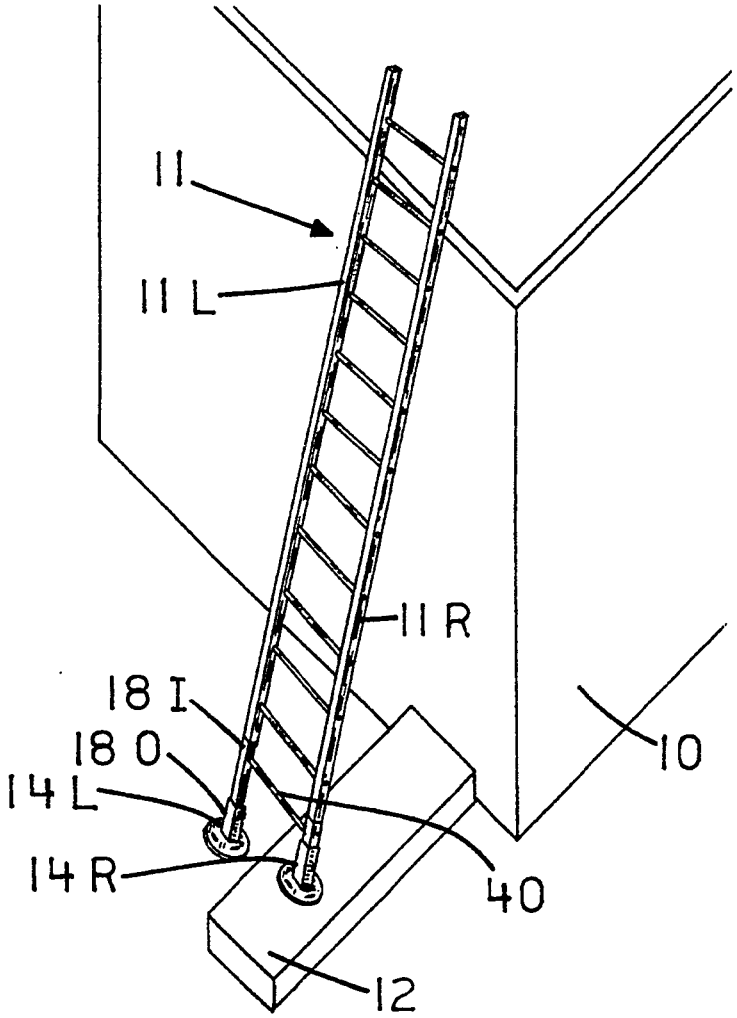
FIG. 1A is a perspective view of a ladder with adjustable rail extensions according to the invention; the ladder is in position adjacent a building with one rail on a raised member adjacent the building.
Figure 1B:
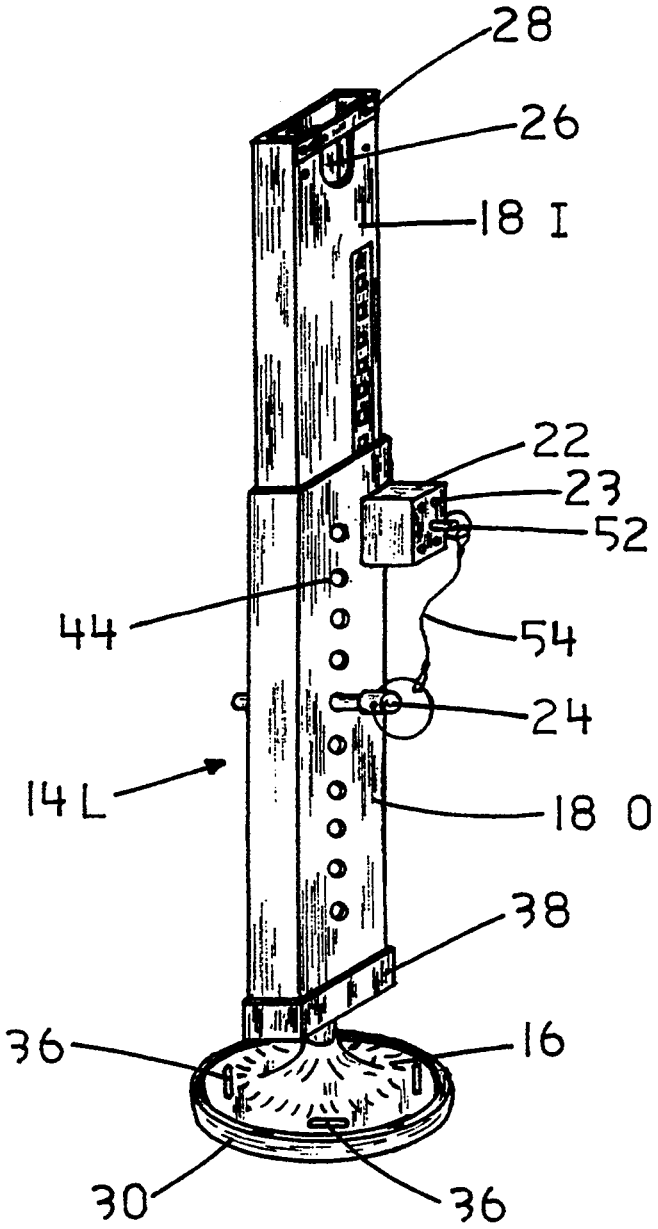
FIG. 1B is perspective view of one adjustable rail extension to the ladder of FIG. 1A.
Figure 1C:
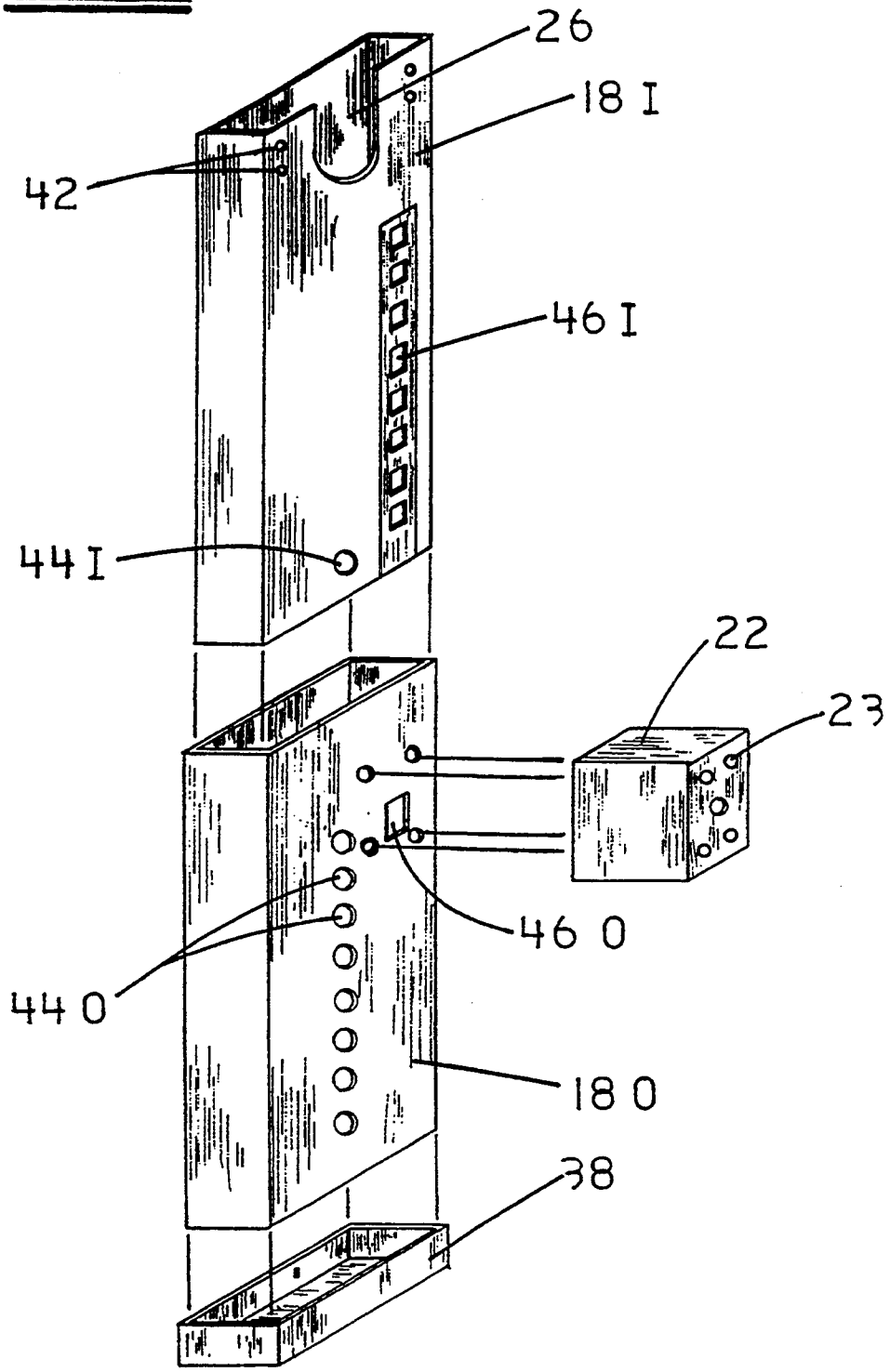
FIG. 1C is an exploded view of the adjustable rail extension.
Figure 1D:
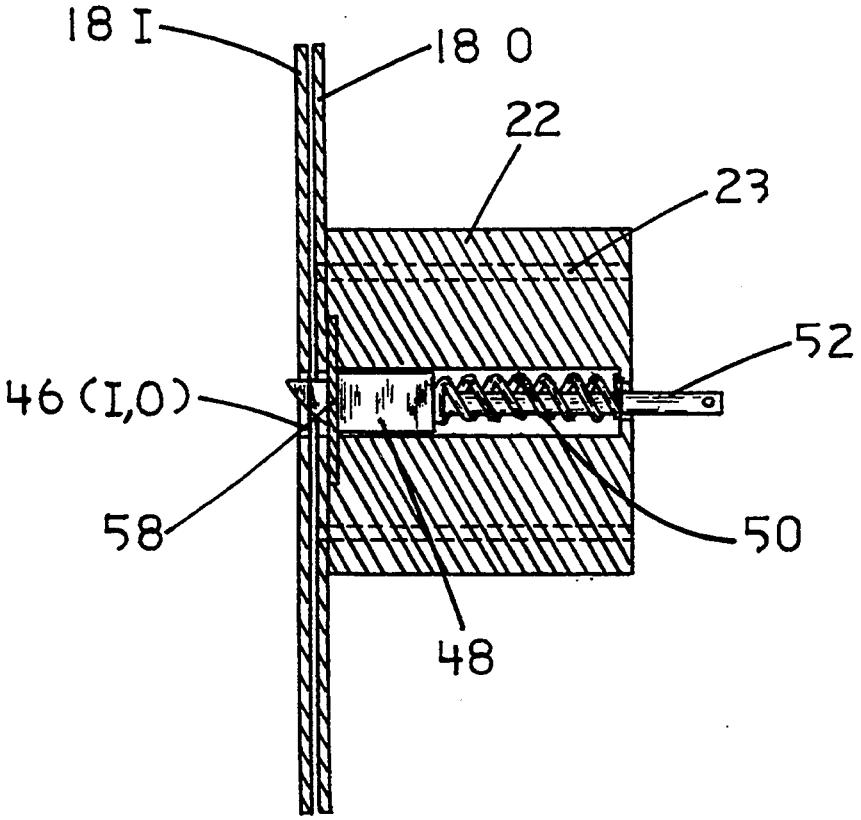
FIG. 1D is a sectional view of a locking mechanism used on such extension.
Figure 1E:
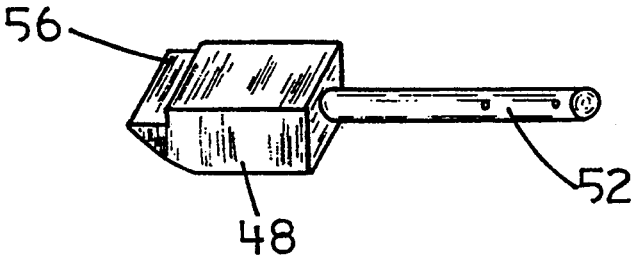
FIG. 1E is a perspective view of a catch used in the locking mechanism.
Figure 1F:
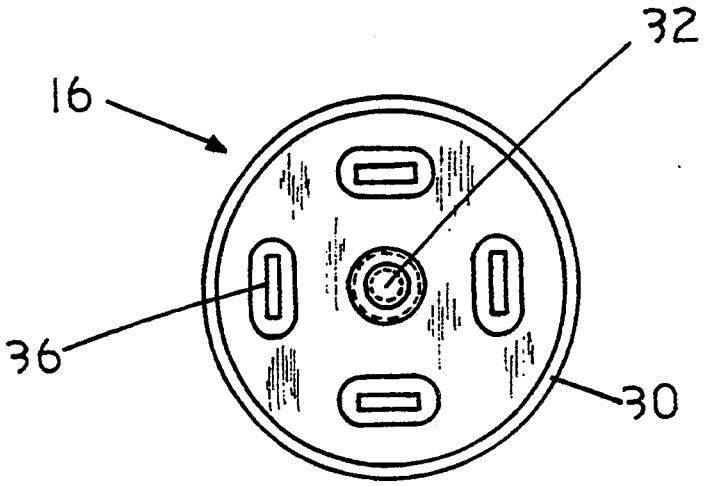
Figure 1G:
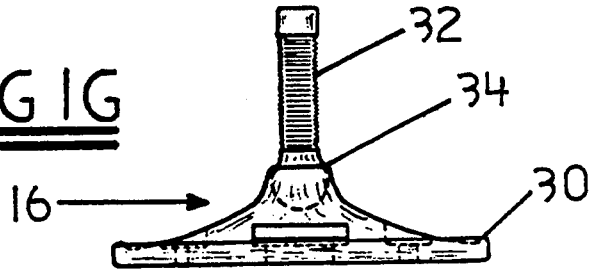
Figure 1H:
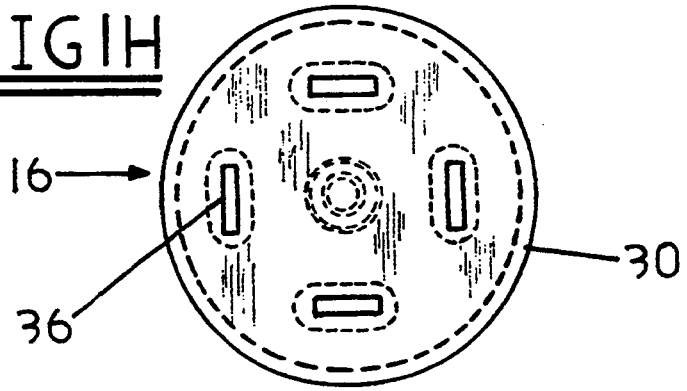

FIGS. 1F, 1G, and 1H are top, side, and bottom views of an adjustable foot used on the adjustable rail extension.

Figure 2A:
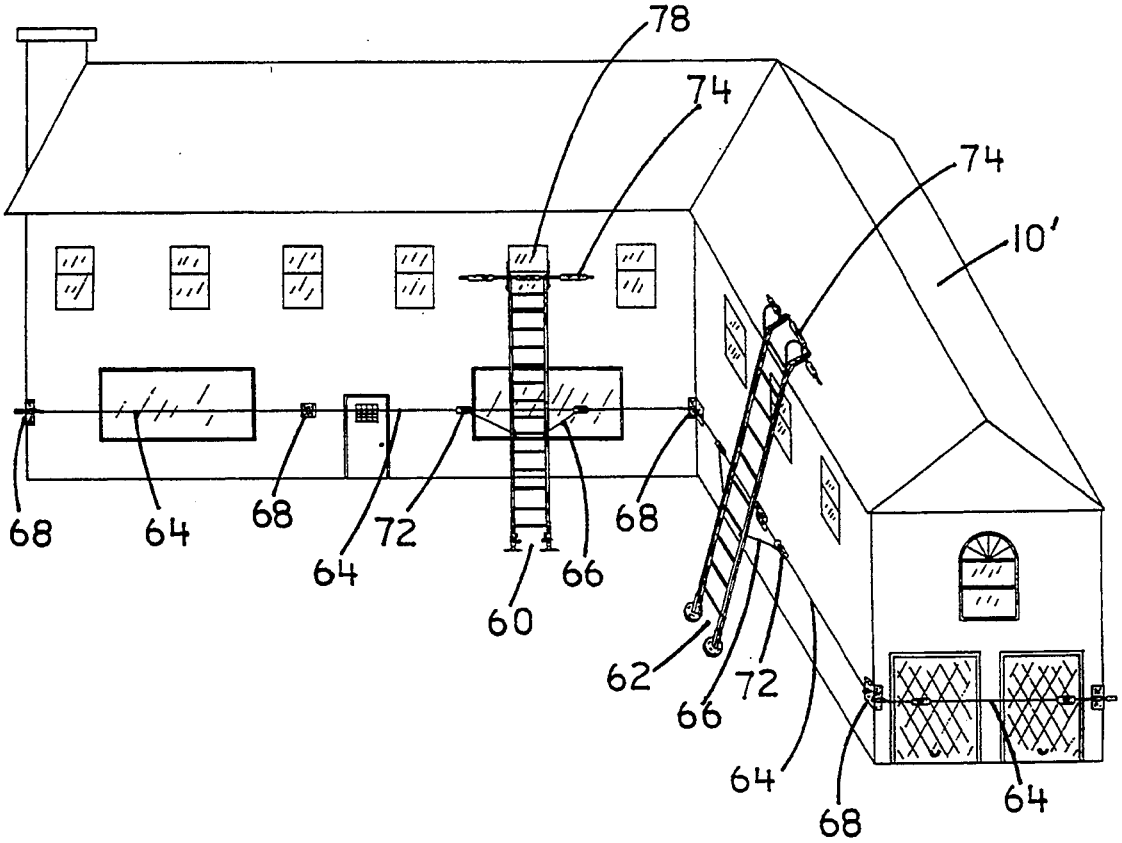

FIG. 2A is a perspective view of several ladders with adjustable rail extensions, stabilizer bars, and safety cables in accordance with the invention in position adjacent a building.

Figure 2B:
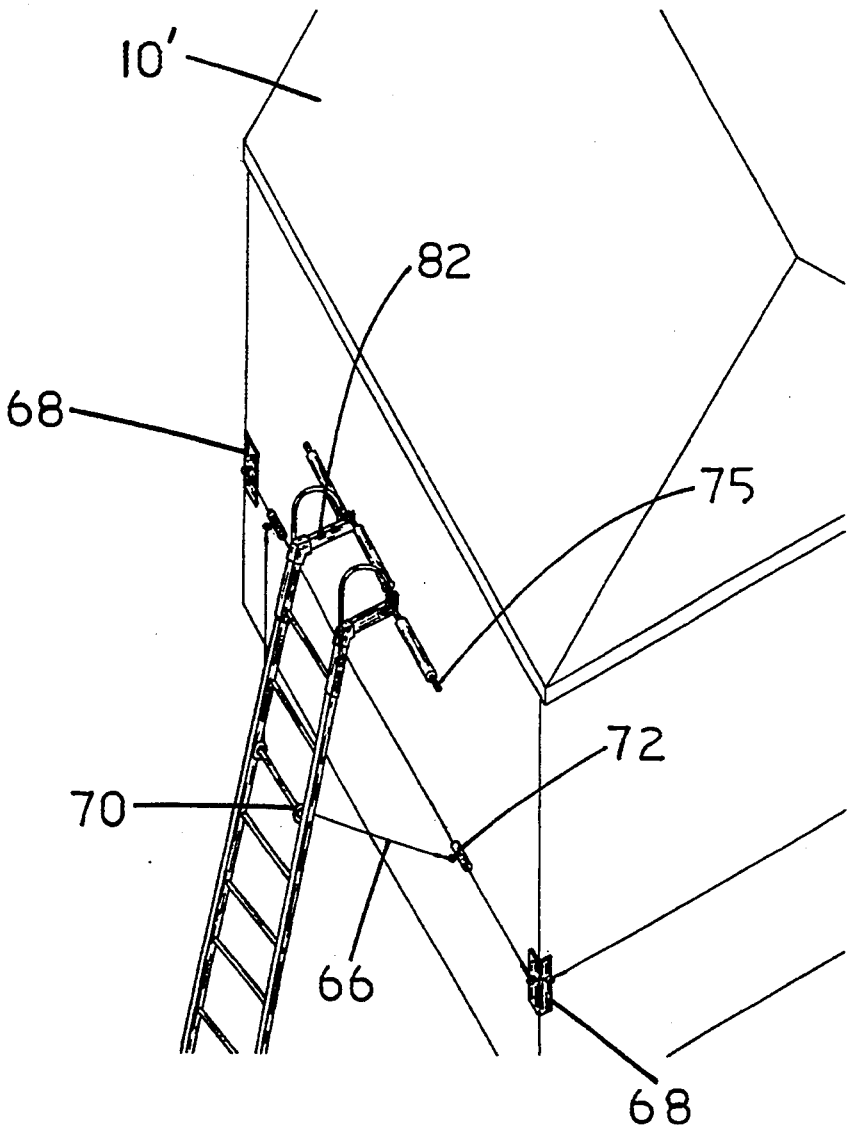
Figure 2C:
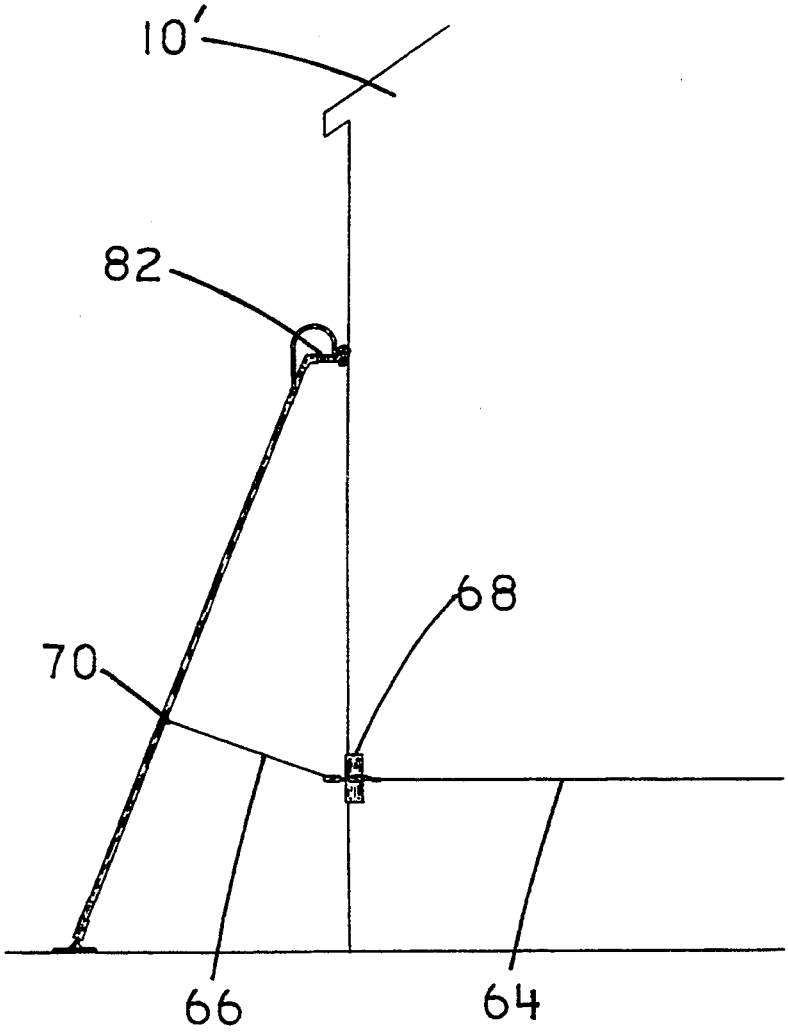

FIGS. 2B and 2C are perspective and side views of a ladder of FIG. 2A in position adjacent the flat side of a building.

Figure 2D:
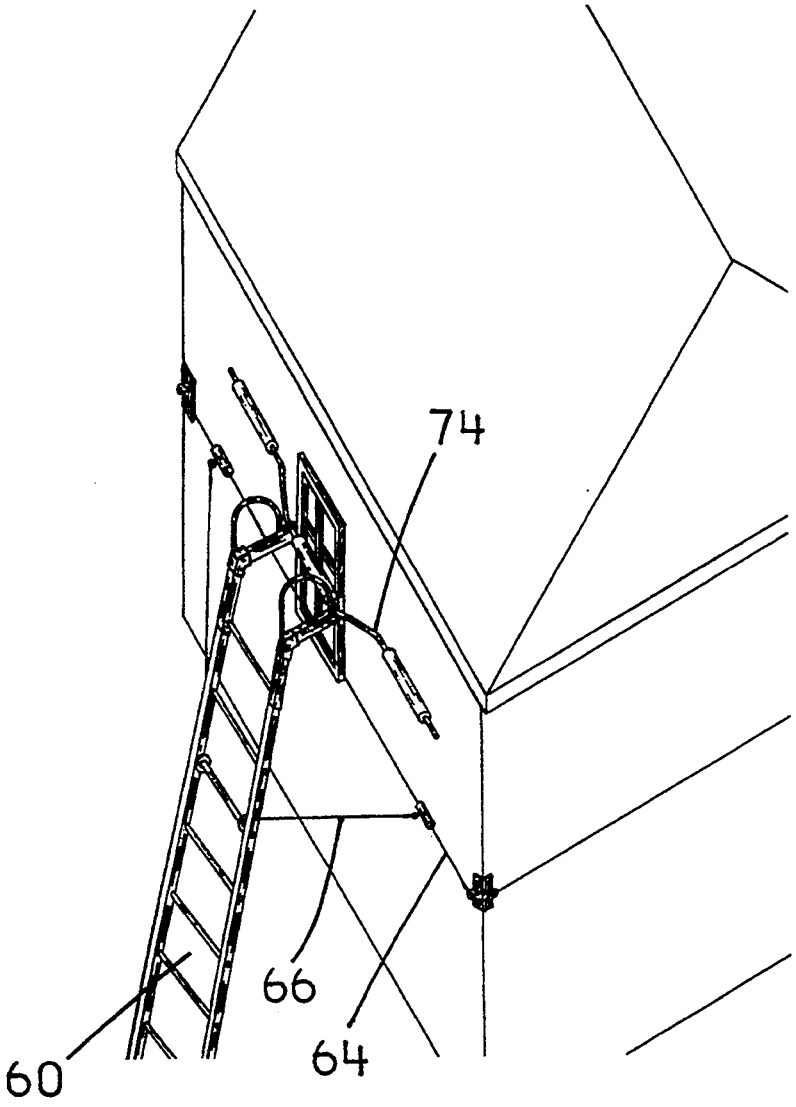

FIG. 2D is a perspective view of a ladder of FIG. 2A in position adjacent the flat side of a building with a window-straddling bar in use.

Figure 2E:
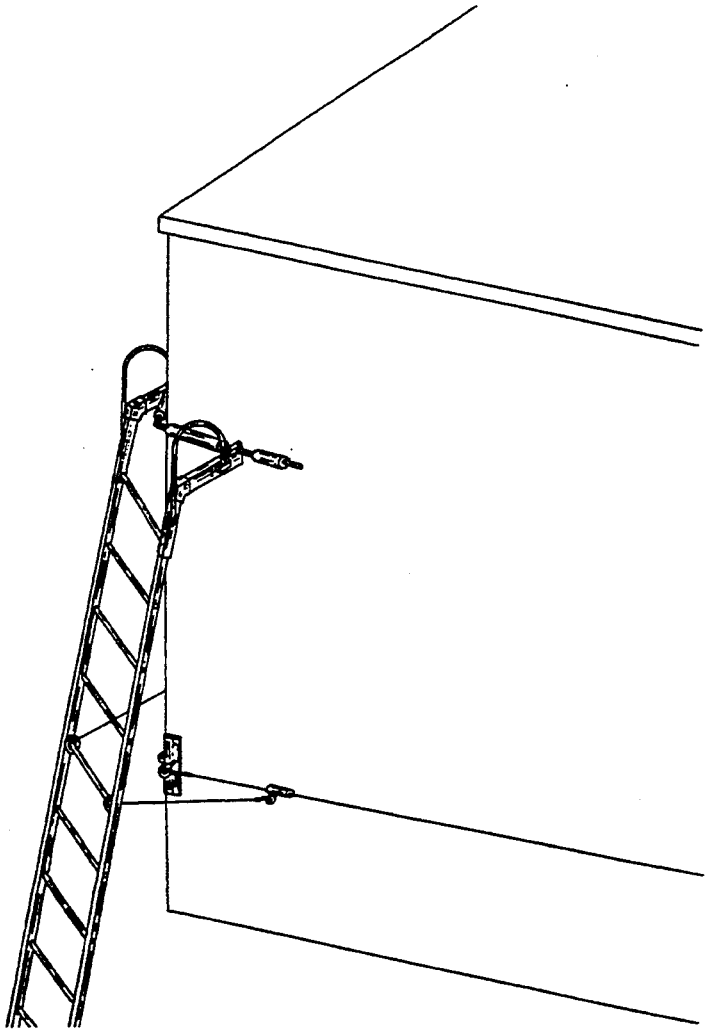
Figure 2F:
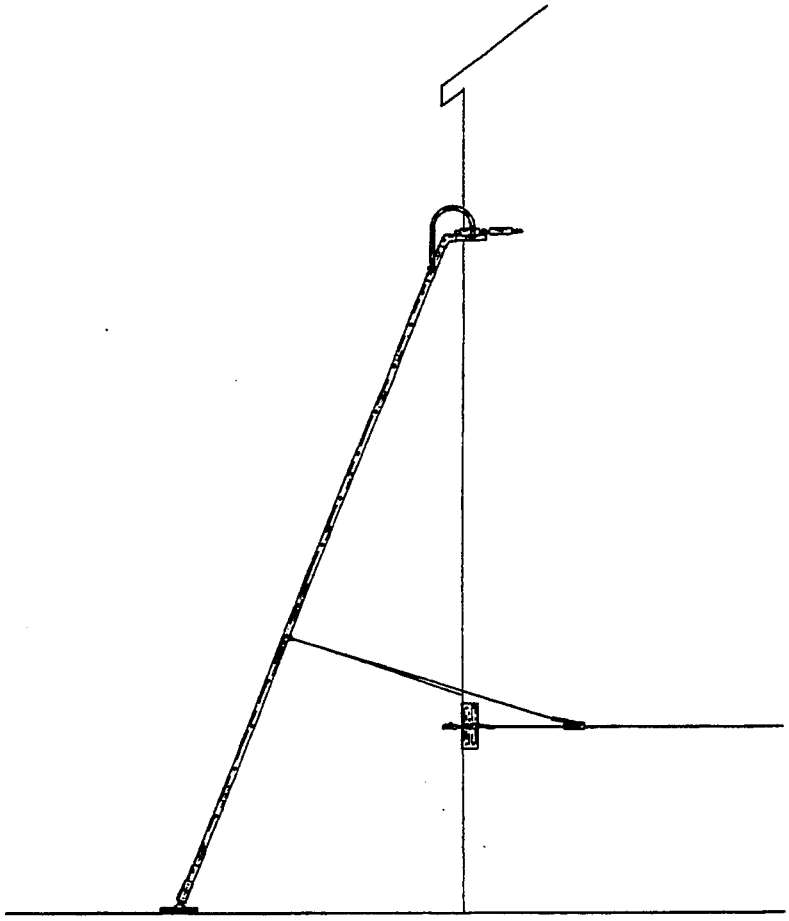

FIGS. 2E and 2F are perspective and side views of a ladder of FIG. 2A in position adjacent an outside corner of a building.

Figure 2G:
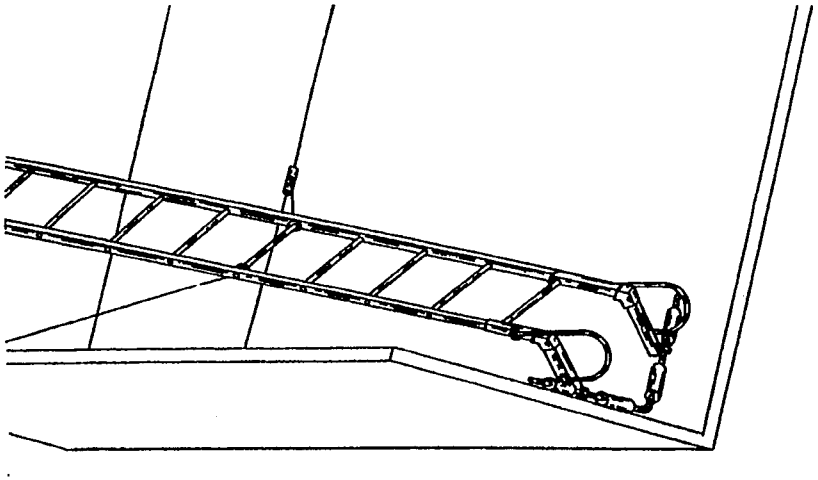

FIG. 2G is a perspective view of a ladder of FIG. 2A in position adjacent an inside corner of a building.

Figure 2H:
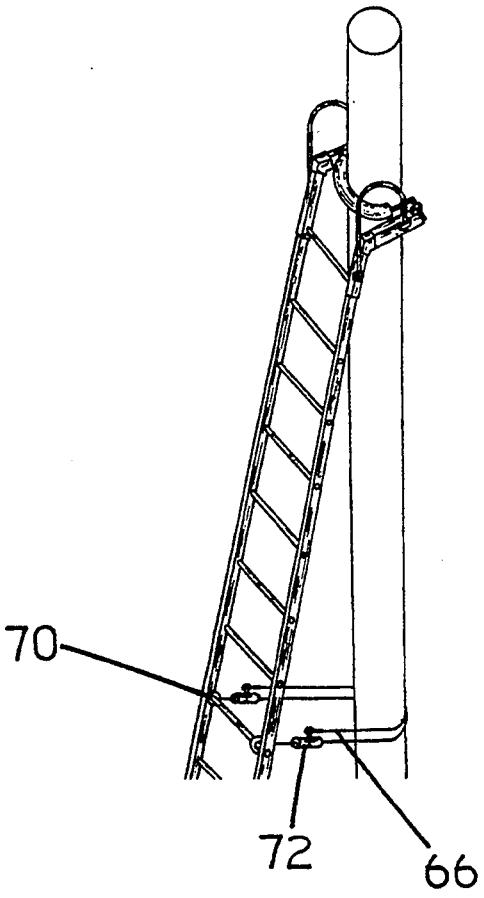

FIG. 2H is a perspective view of a ladder of FIG. 2A in position adjacent a pipe, utility pole, or tree.

Figure 2I:
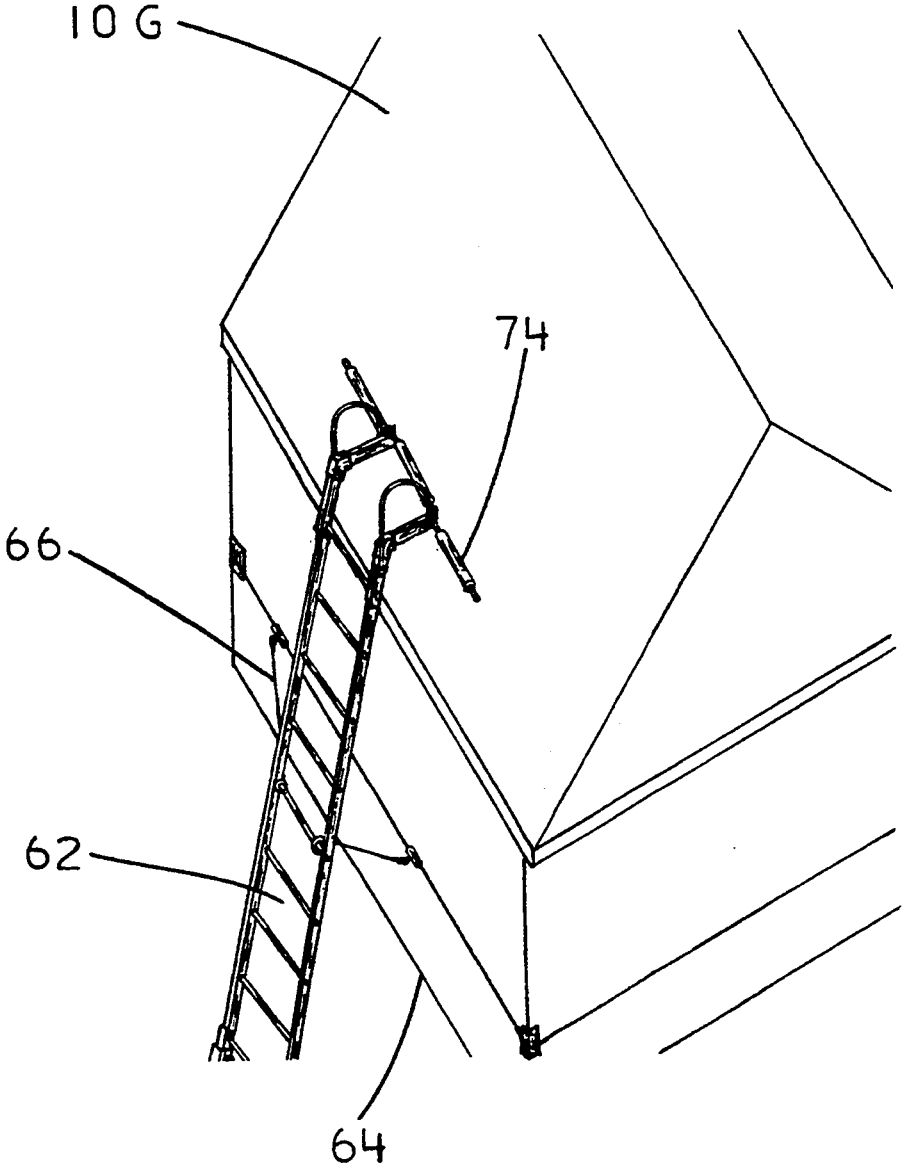
Figure 2J:
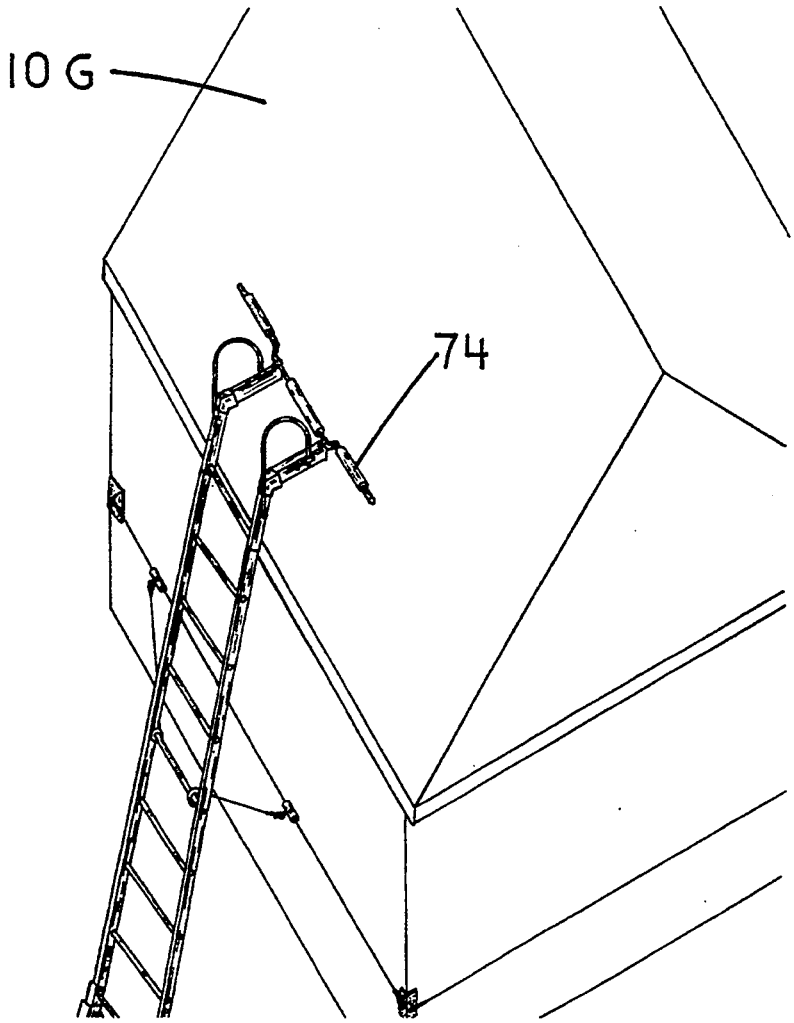

FIGS. 2I and 2J are perspective views of a ladder of FIG. 2A in position adjacent buildings with sloping roofs; these views show a stabilizing bar in down and up positions, respectively.

Figure 3A:
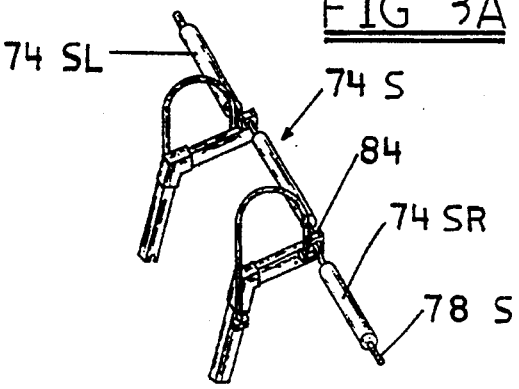
Figure 3D:
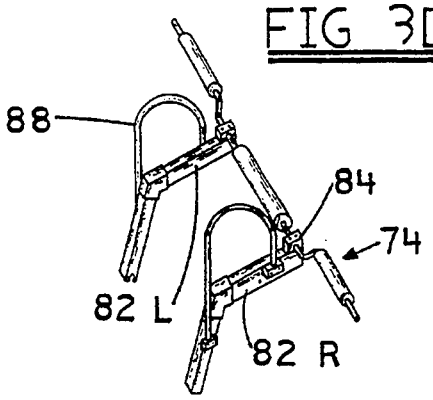
Figure 3B:
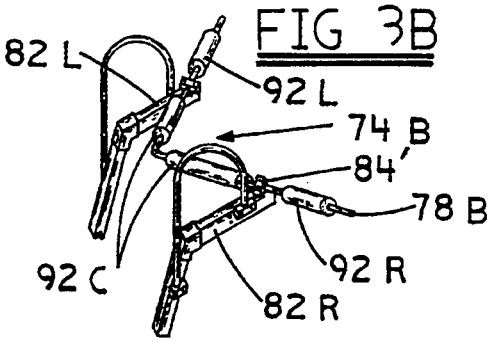
Figure 3E:
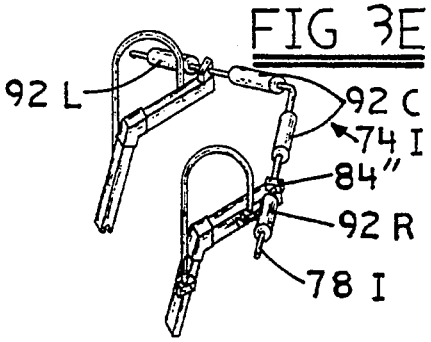

FIGS. 3A to 3F are perspective views of safety bars for use with the ladders of FIG. 2A: FIG. 3A shows a stabilizing bar, FIG. 3B an outside corner bar, FIG. 3C a pipe bar, FIG. 3D shows the bar of FIG. 3A used as a roof safety rail bar, FIG. 3E shows an inside corner bar, and FIG. 3F a window straddling bar.

FIGS. 4A to 4D show cable holding brackets used on the building of FIG. 2A: FIG. 4A shows an outside corner bracket, FIG. 4B an inside corner bracket, FIG. 4C a side view of a flat-wall bracket, and FIG. 4D a front view of the flat-wall bracket.

Figure 5C:
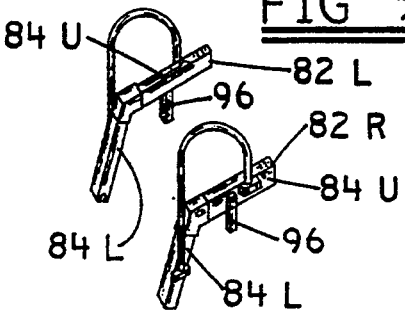
Figure 5A:
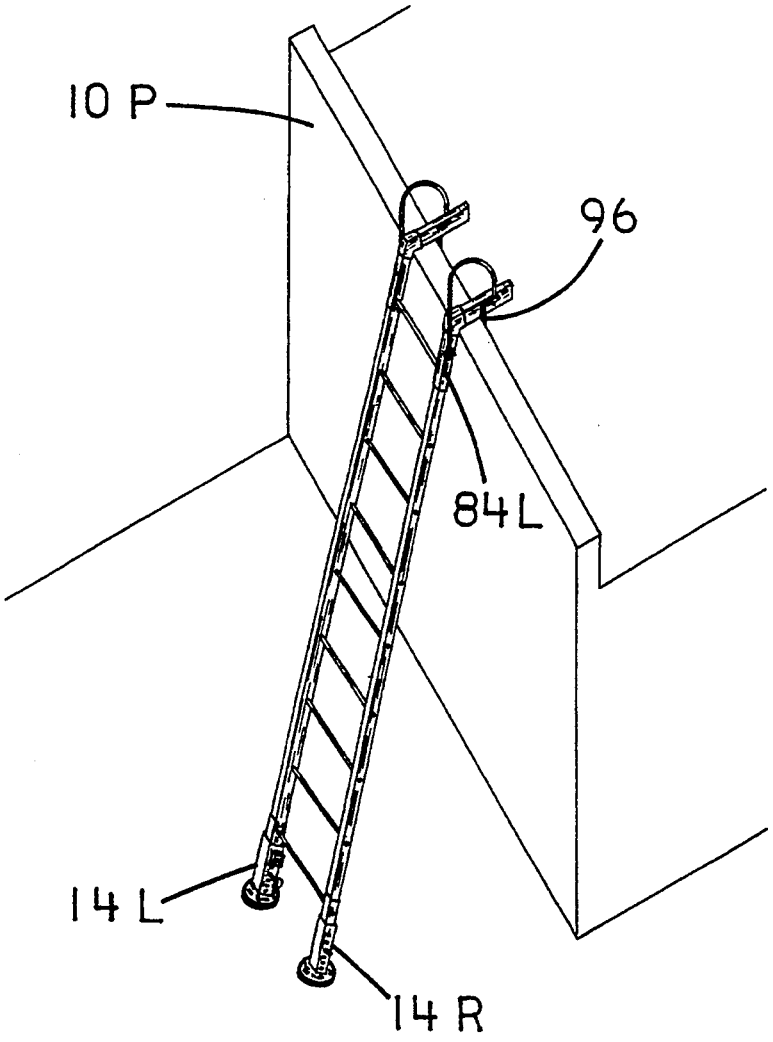
Figure 5B:
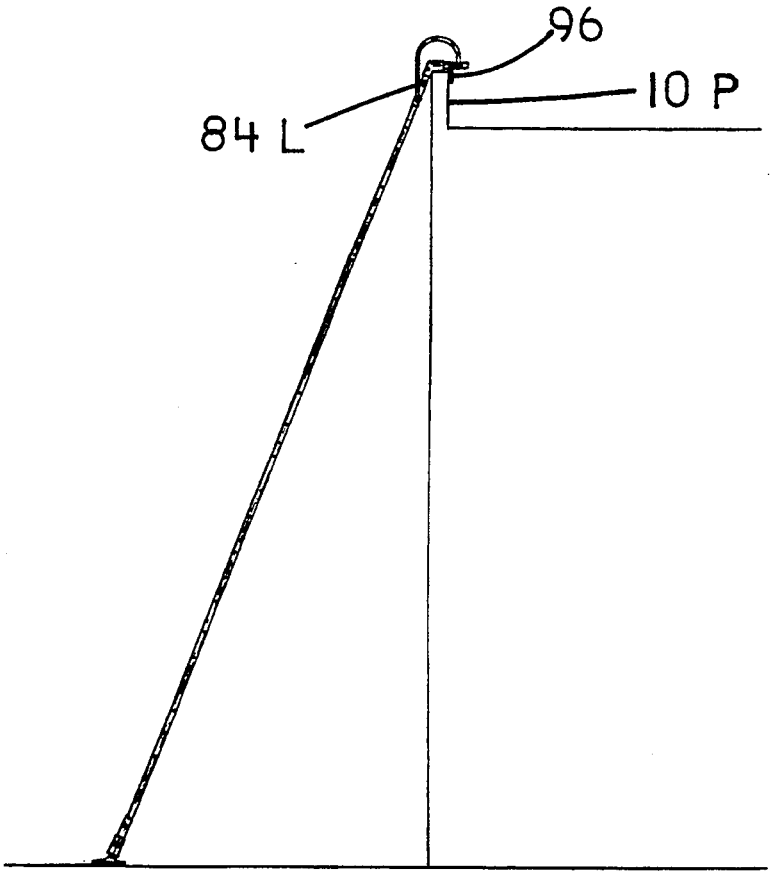

FIGS. 5A and 5B are perspective and side views of a ladder with a parapet-holding hooks; FIG. 5C shows the hooks in detail.

Figure 6A:
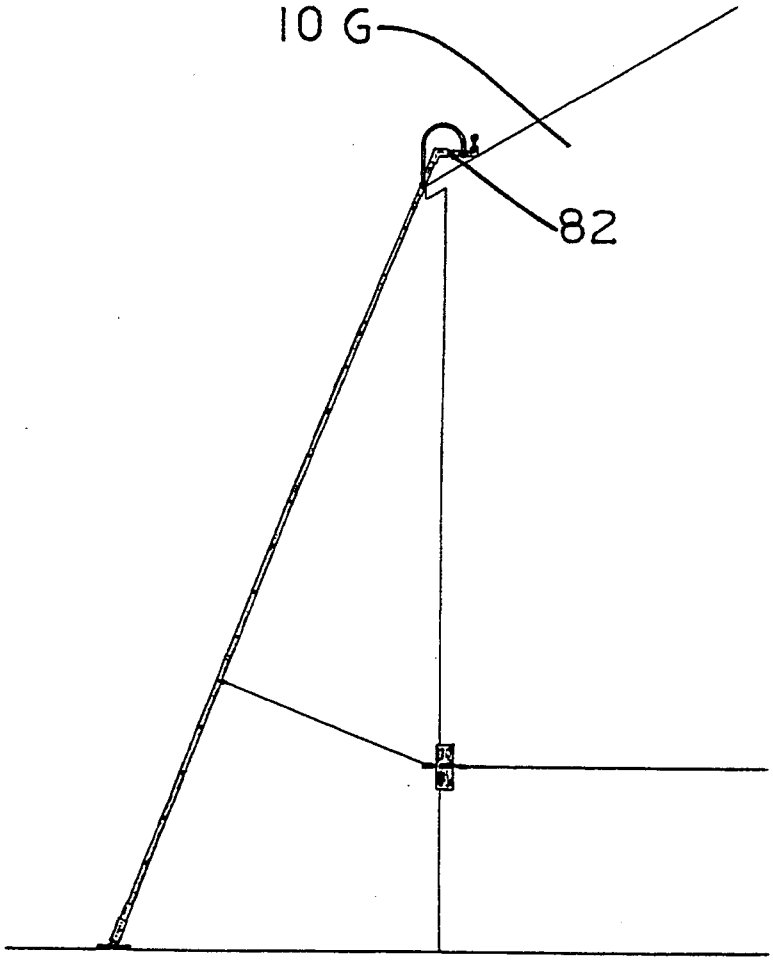

FIG. 6A is a side view of a ladder adjacent a building with a sloping roof and using an extension arm and roof safety rail bar.

Figures 6B, 6C:
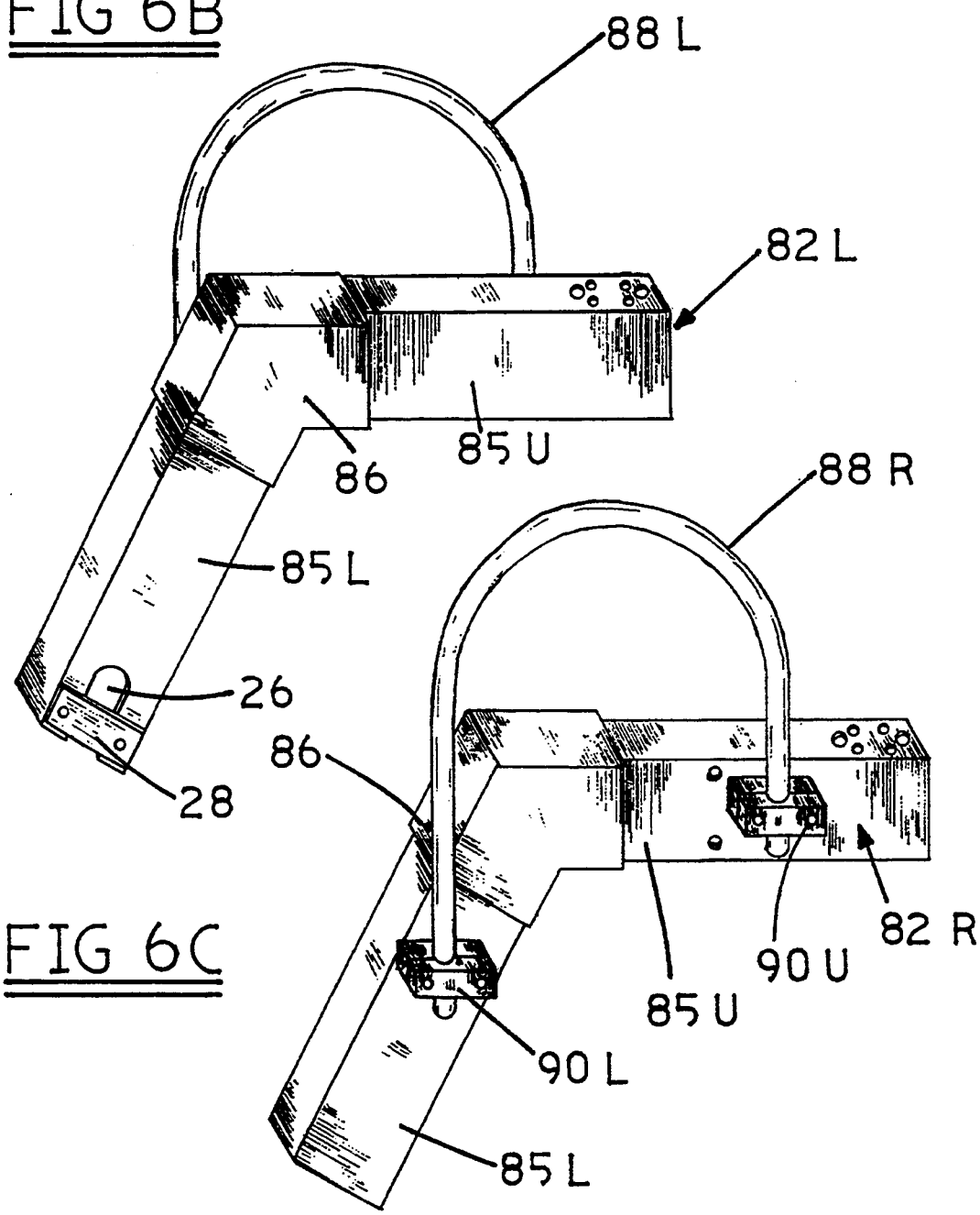
Figure 6D:
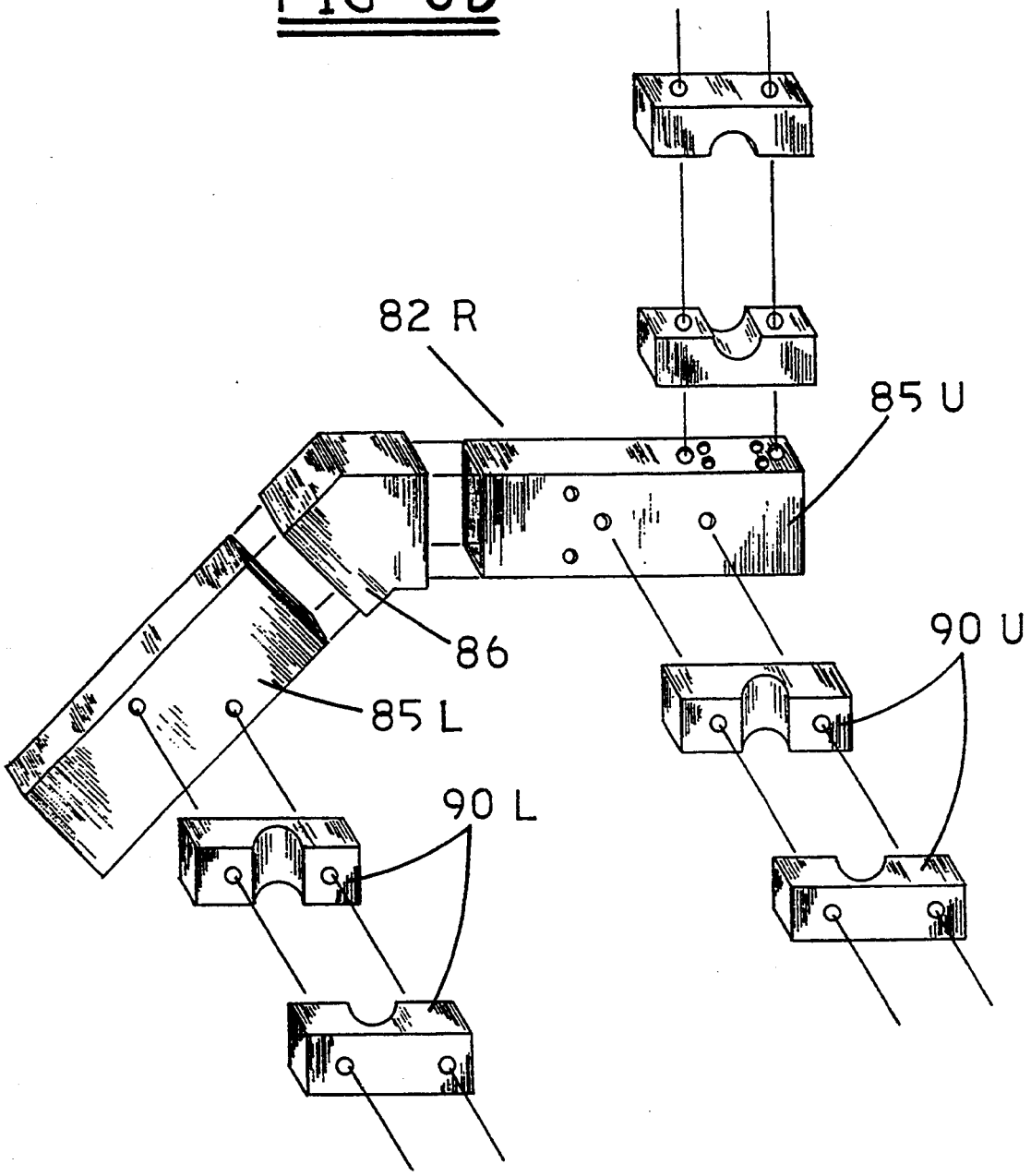

FIGS. 6B and 6C are perspective details of such extension arms and FIG. 6D is an exploded view of such extension arm.

DRAWING REFERENCE NUMERALS

In the reference numerals, letter suffixes represent the following words: l=left or lower; c=center; r=right; i=inner; o=outer; u=upper.

| | |
|---|---|
| 10 building | 11 ladder |
| 11 (l, r) rails of 11 | 12 pipe cover |
| 14 (l, r) rail extension | 16 swivel foot |
| 18 (i, o) telescoping members | 22 catch block |
| 23 holes in 22 | 24 safety pin |
| 26 rung notch | 28 rung lock bar |
| 30 base of 16 | 32 threaded arm |
| 34 ball swivel joint | 36 spike holes |
| 38 bottom portion of 14 | 40 bottom rung |
| 42 mounting holes in 18i | 44 (i, o) circular holes |
| 46 (i, o) square holes | 48 catch plunger |
| 50 spring | 52 operating arm |
| 54 chain and rings | 56 shoulder on 48 |
| 58 retaining plate | 60 ladder w/ window bar |
| 62 ladder w/stabilizing bar | 64 safety wall cable |
| 66 coupling cable | 68 brackets |
| 70 rung hook | 72 cable lock |
| 74 stabilizing bar | 78 metal rod |
| 80 (A-C) sleeve | 82 top extension arm |
| 84 clamp | 85 (u, l) top section of 82 |
| 86 angle bracket | 88 handle hoop |
| 90 clamp | 92 center sleeves |
| 94 center sleeve | 96 parapet hooks |

SUMMARY

In accordance with the invention, adjustable extensions can be attached to the bottom ends of the side rails of a ladder. These extensions can effectively adjust the lengths of such rails so that the ladder will be straight (not leaning to either side), regardless of any difference in heights of the ground or support areas under such rails. Also the ladder is coupled to the wall of building against which the ladder leans by means of coupling cables which connect the midpart of the ladder to a horizontal wall cable which is attached along and parallel to the wall of the building. Further, the top of the ladder is stabilized against rolling to either the left or right and so that it can be positioned stably against irregular supports, such as windows, eaves, pitched roofs, pipes, etc.; such stabilization is provided by means of extension bars connected to its top and suitably shaped to mate with the irregular supports, and by extension arms which project out from the top of the ladder. Hand holds are attached to such extension arms. The extension arms keep the ladder away from the building or work so that the user's body can be closer to the ladder for better stability. Without such arms, the user would have to lean back, away from the ladder to an unsafe position, in order to work comfortably at arm's length from the work.

FIGS. 1A to 1E—Adjustable Rail Extensions—Description

FIGS. 1A to 1E show details of a ladder and rail extensions in accordance with the invention.

As shown in FIG. 1A, a ladder 11 is placed against the side of a building 10. The right rail of the ladder is positioned on a raised member 12, which may be a pipe cover, any raised extension of building 10, or a higher portion of any irregular or sloping ground adjacent building 10. In accordance with the invention, each of the ladder's rails **11*l* and 11*r* has an extension thereon which adjusts the length of the rails so that they will complement cover 12 or any irregular ground. As a result the ladder will be straight (i.e., it will not slope to the left or right) when seen from a horizontal direction perpendicular to its plane or to the side of building 10** against which the ladder is leaning.

In FIG. 1A, an extension **14*l* on left rail 11*l* is lengthened and, optionally, an extension 14*r* on right rail 11*r* is shortened, so that even though the ladder's right rail is positioned on cover 12**, the ladder will not lean to either side. Thus the ladder will be far safer to use than if it sloped when in position, or if it were adjusted by the use of shims, blocks, or some other unstable supports (not shown) under its left rail.

FIG. 1B shows details of extension **14*l*. It comprises a telescoping assembly with a swivel foot 16, an outer telescoping member 18*o*, an inner telescoping member 18*i*, a catch block 22, and a safety pin 24. The upper end of inner member 18*i* has a rung notch 26 and a rung lock bar 28. Notch 26 is preferably about 3.8 cm wide and has a curved bottom with a radius of about 1.5 cm so that it can accommodate a standard circular ladder rung; it extends into inner member 18*i* from the upper end thereof about 7.6 cm. Bar 28 is about 8.9 cm long and is affixed over the mouth of notch 26** by two screws.

Swivel foot 16 is shown in more detail in FIGS. 1F to 1H; it comprises a circular base 30 and a threaded arm 32 which can swivel on base 30 at a ball swivel joint 34. Base 30 has four spike holes 36; spikes (not shown) can be driven through these holes to hold the ladder more stably if it is positioned on loose dirt. Arm 32 is threadedly mated with a female-threaded nut or mounting member (not shown) which is mounted in a bottom portion 38 of outer member **18*o***.

Extension 141 is attached to the ladder as follows: First the ladder's regular stabilizing shoe assemblies (not shown) on the bottoms of its rails are removed. Then rung lock bar 28 is removed and the bottom portion of the ladder's rail is inserted into inner telescoping member **18*i* so that a bottom rung 40 (FIG. 1A) of the ladder fits into notch 26. Then bar 28 is reattached to member 18*i* to lock the extension onto the ladder. Member 18*i* has two sets of mounting holes 42 for bar 28 so that the position of bar 28** can be adjusted.

Inner member **18*i* can slide in outer member 18*o*. Member 18*o* has a series of vertically arranged circular holes 44*o* and inner member has a mating hole 44*i* which slides past holes 44 so that, through the use of catch block 22, member 18*i* can be locked so that its hole 44*i* mates with any one of holes 44*o*. This enables member 18*i* to be locked in any position within a given range with respect to member 18*o***.

Outer member **18*o* also has a square hole 46*o* and inner member 18*i* has a series of vertically arranged mating square holes 46*i*. Catch block 22 is solid and is mounted over hole 46*o* by means of screws (not shown) which are positioned in holes 23; it has a spring-mounted catch plunger 48 (FIGS. 1D and 1E). Plunger 48 normally is biased by its spring 50 so that it extends out of the box and through holes 46*o* and 46*i* to lock the inner and outer members together. Plunger 48 has an operating arm 52 which extends out of the box (FIGS. 1D and 1B) so that it can be pulled out to release plunger 48 from mating holes 46. Arm 52 is attached to safety pin 24 by a wire or chain with appropriate rings 54. Plunger 48 has a shoulder 56 to retain it within catch block 22 by means of a retaining plate 58 (FIG. 1D). Plunger 48 has a beveled front, similar to a door plunger catch, so that outer telescoping member 18o can easily be moved down on inner member 18*i*. To move member 18*o* up on member 18*i*, arm 52 must be pulled out to release plunger 48 from mating holes 46*i* and 46*o***.

Operation—FIGS. 1A to 1E

The ladder of FIG. 1A is operated as follows: The user selects a place for the ladder and then places it in position, e.g., in the position shown in FIG. 1A. If the floor or ground support for one rail is higher than that for the other rail as in FIG. 1A, the ladder will tend to lean to one side, assuming its two rails have equal length. Since the support for the right rail in FIG. 1A is higher than that for the left rail, the ladder will tend to lean to the left (not shown). The user(s) hold the ladder from falling, preferably in an orientation where it doesn't lean to the left or right.

To stabilize the ladder, the user pulls pin 24 of extension 141 (FIG. 1B) out to allow the extension to move down. Then, if the ladder is leaning to the left, the user straightens it and pulls outer member **18*o* of extension 141 down until its swivel foot 16 meets the ground. Then the user locks the two telescoping portions together by inserting pin 24 in whichever pair of holes 44** are mated.

If the user pulls member **18*o* down too far, the user can push it back by first pulling operating arm 52 out to release plunger 48 from holes 46. Then the user inserts pin 24 into a mating pair of holes 44. Next the user makes a fine adjustment by screwing or unscrewing swivel foot 30**. If either foot of the ladder is on non-level ground, the appropriate swivel foot will automatically adjust so that its bottom flat face will be flush against the ground.

If the difference in heights of the ground portions under the ladder's left and right rails is so great that an adjustment of left extension **14*l* will not accommodate the difference, then right extension 14*r* may also be adjusted up, if it has adjustment room available. To adjust right extension 14*r* up, the user first pulls out its safety pin 24 and then its operating arm 52**.

The rail extensions will thus keep the ladder from leaning to either side, regardless of the relative heights of the support areas under its rails. The extensions are simple in design, yet easy to install, very reliable and safe in operation, and very easy to adjust.

FIGS. 2A to 2J—Safety Cables For Ladder

FIGS. 2A to 2J show a ladder with safety cables according to the invention. These ladders also have arm extensions, top safety stabilizing bars, and hand grips which are shown in more detail in FIGS. 3 to 6.

FIG. 2A shows two ladders 60 and 62 which are placed against the sides of building 10'. Both ladders are held in position by safety wall cables 64; the ladders are attached to the wall cables by coupling or ladder cables 66. The ends of wall cables 64 are attached to the building by brackets 68 (shown in more detail in FIGS. 4A to 4D) and coupling cables 66 connect the ladders to the wall cables. The ladder or outer end of each cable 66 is joined to its ladder by rung hooks 70 (FIG. 2B) and to its wall cable by a lock 72 (FIG. 2A). Attached to the tops of ladder 60 and 62 are extension arms and attached to such arms are stabilizing bars 74 (shown in more detail in FIGS. 2D and 3F); these bars hold the ladders more stably against the building.

As shown in FIG. 2A, wall cables 64 are shown mounted by means of brackets 68 around all visible sides of building 10'. Preferably they are mounted at a height of about 1.6 m and at a distance of about 7 to 10 cm from the wall. Brackets 68 are preferably installed on building 10' at all inside and outside corners of the building and at about every 4.5 to 6 m on straight surfaces of the building. FIG. 4A shows an outside corner cable mount **68*a*; note that it comprises two plates mounted at right angles with appropriate mounting holes. Attached to each plate is a projecting eyelet for holding cable 64. FIG. 4A shows an inside corner bracket 68*b*; it is similar to the outside corner bracket except that its plates form an inside corner. FIGS. 4C and 4*d* show a wall bracket 68*c***; it consists of a single plate with a single projecting eyelet and mounting holes.

When ladders are to be used on building 10', e.g., for periodic painting, wall cables 64 can be strung through brackets 68 and pulled taut. The end portion of each cable should be passed through and looped back over an end bracket and attached to the cable with a removable clamp. After the job is completed, the cables can be removed. Alternatively the cables can be precut according to the distance between mating pairs of brackets and have a tightening turnbuckle (not shown) on the main portion of the cable and releasable clamps or hooks at the ends of the cables for ready removability from the brackets. This type of cable can be removed after the job and stored for future reuse.

Coupling cables 66 are attached to wall cables 64 after the wall cables are installed on the building. Each length of wall cable should be precut to a suitable length and plastic coated. Each length can also be color coded to indicate its length. Each coupling cable should be about 1.8 m long with a rung hook 70 at one end so that it can be hooked onto a suitable rung of its ladder. The other end has a cable lock 72 which can move freely on the wall cable segment so that the ladder can be moved along the building, but can be locked to the wall cable at any location. An open eyelet with a threaded cable clamping bolt is suitable for cable lock 72. When the ladder is to be moved to a closely adjacent portion of the building, e.g., for painting a new area, its cable locks 72 can be loosened and the ladder moved to the new location with cable locks 72 sliding on the wall cable. If the ladder is to be moved to a more distant portion of the building, past one or more brackets 68, its cable locks 72 would be loosened and removed from the wall cable, the ladder with its connecting cables attached to its rungs is moved to the desired new location, and its cable locks 72 reattached to the wall cable. Then the two cable locks are moved out to the left and right sides of the ladder as indicated until the connecting cables are taut, whereupon the cable locks can be tightened onto the wall cables.

Operation—FIGS. 2A TO 2J

The safety wall and coupling cables just discussed will hold the ladder a fixed distance from the building, even if the ladder's rails tend to slip out, away from the building, and even if the top of the ladder should be pushed out, away from the building. Even if the ladder is pushed to one side (left or right), the cables will hold it from movement in either of such directions. Thus the safety cables will greatly enhance the ladder's safety and stability, yet they are simple to install, use, and dismantle.

FIGS. 2A to 2J And Other FIGS.—Top Stabilizing Bars And Arm Extensions

The tops of the ladders of FIGS. 2A to 2J are also stabilized by means of extension arms and top bars.

Bars 74, attached to extension arms at the tops of ladders 60 and 62, respectively, extend out to the right and left of their ladders and thereby provide added stability to prevent the ladders from tipping or rolling to the side.

Bar 74 has a offset center section (FIGS. 2D and 3F) so that it can straddle a window 78 (FIG. 2A). Bar 74 comprises a metal inner rod 75 with three sections. The sections have respective soft sleeves 80*c* (center), 80*l* (left), and 80*r* (right) fitted thereover so as to pad rod 75, prevent damage to the building, and enhance stability by preventing slippage on the building's wall. The center section of the rod is offset from the outer sections by two bends and is mounted to the tops of two top arms or extensions 82 of ladder 60 by two clamps 84. Bar 74 can be made in larger versions for straddling large windows and other large building projections.

The offset end or outer sections of bar 74 project forward of the center section. Thus when the ladder is placed against a wall of the building (FIG. 2D), the end sections of the bar will rest against the wall. This will hold the center section and extension arms 82 away from the window so as to protect the window and its frame.

Extension arms 82, best seen in FIGS. 6B, 6C, and 6D as top arm 82*l* and 82*r*, each comprise top and bottom sections 85*u* (upper) and 85*l* (lower). Each section is about 41 cm long, and the two sections are joined at an angle of about 116° by an angle bracket 86. The lower section has a lumen which is sized to fit over the top of the side rail and top rung (not shown in FIGS. 6B and 6C) of the ladder using a rung notch 26 and a rung bar 28, in a manner similar to that in which the lower extensions are joined to such side rails in Fig 1B. Arms 82 may be made of metallic rectangular tubing, sized to slide over the ladder's side rails somewhat snugly. The extension arms include clamps 84 for holding the stabilizing arms rigidly.

Handle hoops 88*l* and 88*r* are attached to the top arms by two-piece clamps 90*u* and 90*l*. Hoops 88 are formed of tubing which is bent into a U-shape, with one rail of the "U" longer than the other so that the hoops can fit onto the two sections of arms 82.

FIGS. 3A and 3D: When the top of the ladder is placed against a flat support, as in FIGS. 2B and 2I, a bar extension 74S with a metal rod 78S which is only slightly offset is used, as shown in FIG. 3A. This bar's slightly offset side portions 74S*r* and 74S*l* are offset about 8.9 to 10 cm from the center portion as shown so as to counter any tendency for the bar to roll or turn. The offset end portions are bent down when used against a flat support, such as a building's side wall. Note that wall cables and coupling cables are also used with all versions of the bar extensions to enhance the ladder's safety. When the top of the ladder is placed against a pitched roof, as shown at the right front in FIG. 2A and in FIG. 2I, its offset end portions are bent down, as shown in FIG. 3A so as to provide stability on the sloping roof. The offset end portions can also be bent up, as shown in FIGS. 3D, 2J, and 6A to provide a guard to block a person doing roof repair from slipping off the roof; in this case the ladder should be attached to the building with cables.

FIG. 3B: When the top of the ladder is to be placed against an outside corner of a building, as shown in FIGS. 2E and 2F, a bent bar extension 74B with a metal bar 78B with a right-angle bend is used, as shown in FIG. 3B. This bar has two center sleeves 92C and two outer left and right sleeves 92*l* and 92*r*. It is mounted by means of clamps 84' which are attached at angles to extension arms 82*r* and 82*l*.

Figure 3C:
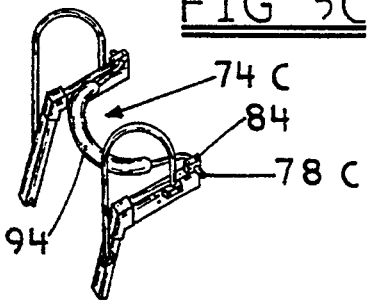
Figure 3F:
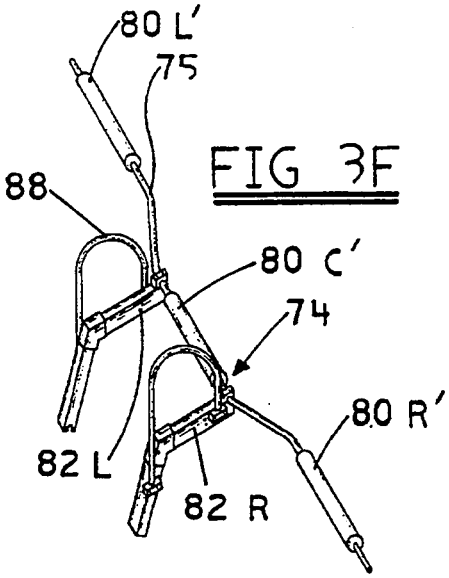

FIG. 3C: When the top of the ladder is to be placed against a pipe, utility pole, or tree as shown in FIG. 2H, a curved bar extension 74C with a curved metal bar 78C is used, as shown in FIG. 3C. This bar has one center sleeve 94. The ends of bar 78C are curved out so that the bar can be mounted by clamps 84. Two coupling cables 66 are used to connect the ladder to the pipe as shown. The user attaches hook 70 at one end of each cable to the pipe, loops the cable around the pipe, and attaches cable lock 72 at the other end of each cable to the other cable. Locks 72 are then pulled taut and locked.

FIG. 3E: When the top of the ladder is to be placed against an inside corner of a building, as shown in FIG. 2G, a bent bar extension 74*i* with a metal bar 78*i* with a right-angle bend reversed from that of FIG. 3B is used, as shown in FIG. 3E. This bar has two center sleeves 92C and two outer left and right sleeves 92*l* and 92*r*, similar to that of FIG. 3B. It is mounted by means of clamps 84" which are attached at angles (opposite to those of FIG. 3B) to extension arms 82*r* and 82*l*. Bent bar extension 74*i* of FIG. 3E can be the same as that of FIG. 3B, except that it is reversed.

FIGS. 5A and 5B: For mounting the ladder against the top of a building with a parapet, as shown at 10P in FIG. 5A, 5B, and 5C, or for mounting it adjacent overhead pipes, beams, tree limbs, etc. (not shown), upper portions 84U of extension arms 82*r* and 82*l* have parapet-holding hooks 96 which are straight, elongated members which are mounted to arms 84U and which extend down from such arms. Preferably hooks 96 are about 76 cm long and are spaced from lower portions 84*l* by about 76 cm so that the space between hooks 96 and lower portions 84*l* can fit over the building's parapet, as shown in FIGS. 5A and 5B. These hooks hold the ladder very securely onto the parapet so that the wall and coupling cables are not needed. However, as indicated in FIG. 5A, bottom extensions 14 should still be used.

FIG. 6A: If the ladder is to be used against a building with a pitched roof, as shown in FIGS. 2I, 2J, and 6A at 10G, extension arm 82 will aid in stabilizing the ladder by contacting the roof while the ladder itself contacts the edge of the roof, as indicated. Stabilizing bar 74 (FIGS. 2I and 2J) also helps to hold the ladder against rolling; its offset sections are bent up as in FIG. 3D.

Operation—Top Stabilizers

The bar extensions just discussed will prevent the ladders from rolling or turning to either side, thereby greatly enhancing its stability. Also they will hold it away from windows, preventing injuries from broken glass, injuries due to the ladder falling through the window, etc. The bar extensions are especially useful for stabilizing the ladder against corners of the building, both inside and outside, as well as utility poles, trees, pipes, etc. The parapet hooks will hold the ladder very stably by hooking over and holding the ladder to a parapet. Finally the handle hoops aid user safety by providing both a side rail when the user is at the top of the ladder and a hand hold for the user so that he or she can climb over the top of the ladder onto the roof with a readily accessible grip.

All of the components (cables, bottom extensions, hand hoops, arm extensions, bar extensions) preferably are sold in a kit form so that they can be attached to the ladder and/or building as needed in any suitable configuration to match the building's shape. E.g., if the ladder is to be placed against a pipe, the pipe bar of FIG. 3C and the cables of FIG. 2H would be attached to the ladder as indicated in FIG. 2H. If the ladder is to be used with a building with a parapet, the parapet hooks with top extensions would be attached, with suitable bars. The components can be attached by conventional screws, or nuts and bolts (not shown).

The extension arms and bars greatly enhance the safety of the top of the ladder, especially when it is rested against irregular supports, such as pitched roofs, parapets, pipes, windows, etc. The extensions are simple to install, use, and dismantle, yet they will provide greatly added stability so as to substantially reduce falls, injuries, and liability.

Summary, Ramifications, and Scope

Accordingly the reader will see that, according to the invention, I have provided ladder attachments which enable the ladder to be positioned on almost any surface without leaning to either side, regardless of the difference in heights of the ground or floor areas under its respective rails. Also it can be positioned stably against almost any building, support, including buildings with a parapet, eaves, a pitched roof, an inside corner, or an outside corner, a pipe, etc. Also, by providing wall cables and coupling cables, the ladder can be attached to virtually any building so that it cannot fall out or away from the building. The top bars and extensions, and the parapet hooks hold the ladder stably against the top of virtually any building, regardless of its configuration. Thereby I have provided ladders with increased safety and with the ability to remain stable on irregular ground or irregular buildings. The ladders will prevent and reduce falls and injuries to workers, reduce legal and fiscal problems for ladder manufacturers, the cost of liability insurance, the time and effort needed to defend lawsuits, the need for numerous safety warnings on ladders, the loss of executive time in dealing with lawsuits, the prices of most ladders, and the namer of ladder manufacturers which go out of business due to damage judgments.

While the above description contains many specificities, these should not be construed as limitations on the scope of the invention, but as exemplifications of the presently-preferred embodiments thereof. Many other ramifications and variations are possible within the teachings of the invention. For example, the ladders can also have personnel safety straps, fixed, rather than modular attachments, bendable top bars, top bars which can be inserted through aligned holes in the side rails of the ladder, fixed bars and coupling arms, rather than cables, etc.

Thus the scope of the invention should be determined by the appended claims and their legal equivalents, and not by the examples given.

I claim:

1. A ladder and holding apparatus for adding additional support to said ladder when said ladder is leaning against a generally vertical structure which extends up from a generally horizontal supporting surface, comprising:

a vertical structure extending up from a generally horizontal supporting surface, a ladder which is rigid, elongated, and comprises a pair of parallel, elongated, vertical, rigid, straight side rails interconnected by a plurality of spaced, horizontal, rigid rungs, each of said side rails having a bottom end which rests upon and is supported by said generally horizontal supporting surface at two separated locations which are each spaced horizontally away from said vertical structure, an upper part of said ladder leaning against an upper part of said vertical structure such that said ladder is slanted at an angle to the vertical, an anchor comprising a cable which is mounted horizontally along said vertical structure at an intermediate location spaced up from said horizontal surface and down from said upper part of said vertical structure for providing at least one anchor point on said vertical structure to which an interconnection member can be attached, and an interconnection member comprising an elongated flexible member attached between said anchor and a part of said ladder spaced up from said bottom ends of said rails for holding said ladder so that said part of said ladder cannot be pulled out from said anchor farther than the length of said elongated member, whereby said ladder will be stabilized against shifting.

2. The ladder and holding apparatus of claim 1 wherein said interconnection member comprises a cable having means at one end thereof which can be attached and secured to a rang of said ladder.

3. A ladder and holding apparatus for adding additional support to said ladder when said ladder is leaning against a generally vertical structure which extends up from a generally horizontal supporting surface, comprising:

a vertical structure extending up from a generally horizontal supporting surface, a ladder which is rigid, elongated, and comprises a pair of parallel, elongated, vertical, rigid, straight side rails interconnected by a plurality of spaced, horizontal, rigid rungs, each of said side rails having a bottom end which rests upon and is supported by said horizontal supporting surface at two separated locations which are each spaced horizontally away from said vertical structure, an upper part of said ladder leaning against an upper part of said vertical structure such that said ladder is slanted at an angle to the vertical, anchor means attached to said vertical structure at an intermediate location spaced up from said horizontal surface and down from said upper part of said vertical structure, said anchor means providing at least one anchor point on said vertical structure, said anchor means comprising a cable which extends horizontally adjacent said vertical structure, and interconnection means comprising an elongated flexible member attached to said anchor means and to a part of said ladder spaced up from said bottom ends of said rails for holding said ladder so that said part of said ladder cannot be pulled out from said anchor means farther than the length of said elongated member, whereby said ladder will be stabilized against shifting.

4. The ladder and holding apparatus of claim 3 wherein said interconnection means comprises a cable having means at one end thereof which can be attached and secured to a rung of said ladder.

* * * * *

UNITED STATES PATENT AND TRADEMARK OFFICE

CERTIFICATE OF CORRECTION

PATENT NO.: 5,373,913

DATED: Dec 20, 1994

PATENTEE(S): Virgil Santos

I t is certified that error appears in the above-identified patent and that said Letters Patent is hereby corrected as shown below:

Col. 9, line 68, change "namer" to —number—.

Signed and Sealed this

Seventh Day of March, 1995

*Attest:*

Bruce Lehman

BRUCE LEHMAN

*Attesting Officer*

*Commissioner of Patents and Trademarks*